US006758189B2

(12) United States Patent
Uraki et al.

(10) Patent No.: US 6,758,189 B2
(45) Date of Patent: Jul. 6, 2004

(54) ENGINE REVOLUTION CONTROL APPARATUS HAVING OVERSPEED GOVERNING CAPABILITY

(75) Inventors: Mamoru Uraki, Saitama (JP); Sumio Sato, Saitama (JP); Tomoya Kono, Saitama (JP); Hajime Shogase, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 18 days.

(21) Appl. No.: 10/309,008

(22) Filed: Dec. 4, 2002

(65) Prior Publication Data

US 2003/0106523 A1 Jun. 12, 2003

(30) Foreign Application Priority Data

Dec. 10, 2001 (JP) ..... 2001-375414

(51) Int. Cl.[7] ..... F02D 1/00

(52) U.S. Cl. ..... 123/325; 123/329; 123/333; 123/335

(58) Field of Search ..... 123/319, 320, 123/321, 325, 329, 330, 331, 332, 333, 334, 335, 198

(56) References Cited

U.S. PATENT DOCUMENTS 3,768,004 A * 10/1973 Abnett et al. ..... 324/392
4,169,371 A * 10/1979 Witschi et al. ..... 73/116
4,370,964 A * 2/1983 Muranaka et al. ..... 123/406.35
4,697,560 A * 10/1987 Umehara ..... 123/335
5,537,967 A * 7/1996 Tashiro et al. ..... 123/192.1

FOREIGN PATENT DOCUMENTS

JP 9-126019 A 5/1997

* cited by examiner

*Primary Examiner*—John Kwon
(74) *Attorney, Agent, or Firm*—Birch, Stewart, Kolasch & Birch, LLP

(57) ABSTRACT

When a large load is exerted during restraint control of an engine of a jet propulsion boat, the drop of the engine revolution frequency causes a feeling of harsh braking. An engine revolution frequency control apparatus provided to prevent this problem includes a engine revolution frequency detector for detecting an engine revolution frequency, and threshold value setting units for setting first and second engine revolution frequency threshold values. The second threshold value is set to be higher than the first threshold value. An engine control unit includes an overspeed governing capability that starts restraint control for restraining rotation when the engine revolution frequency detected by the engine revolution frequency detector is more than said first threshold value when the engine is accelerating, and terminates restraint control when the engine revolution frequency is less than a second thresholds value during deceleration.

12 Claims, 6 Drawing Sheets

Comparative Example

Embodiment

ENGINE REVOLUTION CONTROL APPARATUS HAVING OVERSPEED GOVERNING CAPABILITY

CROSS-REFERENCE TO RELATED APPLICATION

This nonprovisional application claims priority under 35 U.S.C. §119(a) on Patent Application No. 2001-375415 filed in JAPAN on Dec. 10, 2001, which is herein incorporated by reference.

BACKGROUND OF THE INVENTION

1. Field of the Invention

The present invention relates to an improved engine revolution frequency control apparatus having an overspeed governing capability.

2. Description of Background Art

An engine has a prescribed allowable maximum revolution frequency, and operation exceeding this allowable maximum revolution frequency must be avoided in terms of protection of the engine. As an overspeed prevention technology, "the engine control apparatus" disclosed in JP-A-9-126019 is known. This technology is such that a control unit suppresses and controls the engine revolution frequency when the pace of increase in engine revolution frequency reaches the prescribed value or larger.

The technology disclosed in the aforementioned patent gazette can prevent an abrupt increase in engine revolution frequency even when it occurs in the low speed area or medium speed area, because the pace of increase in revolution frequency is observed. However, since observation is made based on the pace of increase in revolution frequency, it is not able to detect that the engine revolution frequency is beyond the allowable maximum speed when the engine revolution frequency is increased relatively slowly.

The apparatus is adapted to restrain the engine revolution frequency when either the engine revolution frequency exceeds a prescribed value, or the pace of increase in revolution frequency exceeds a prescribed value is detected. However, the control system becomes complex, and restraint control of the engine is not implemented sufficiently to maintain the ride quality of the vehicle or the boat.

SUMMARY AND OBJECTS OF THE INVENTION

Accordingly, it is an object of the present invention is to provide an engine revolution frequency control apparatus in which a preferable overspeed governing capability can be achieved.

In order to solve the problem described above, the engine of the present invention includes a revolution frequency detecting means for detecting the engine revolution frequency and an engine control unit for controlling the engine revolution frequency. The engine control unit is provided with an overspeed governing capability that starts restraint control for restraining rotation when the engine revolution frequency detected by the engine revolution frequency detecting means exceeds a first threshold value during acceleration, and terminates restraint control when the engine revolution frequency is decreased to the value below a second threshold during deceleration, and the second threshold value of the engine revolution frequency is set to be higher than the first threshold value.

Restraint control of the engine revolution frequency may be realized by cutting or reducing supply of fuel, leaning of air-fuel mixture, delaying of the ignition timing, or reducing the number of times of ignition.

Even when restraint control is started by the fact that the engine revolution frequency exceeds the first threshold value, increase in revolution frequency continues for a while due to inertia. After that, when restraint control comes on or when a large load is exerted thereon, the engine revolution frequency starts to be reduced. When a large load is exerted, even when terminating restraint control at a certain threshold value, reduction of the engine revolution frequency continues for a while, which result in significant drop of the engine revolution frequency.

Therefore, according to the present invention, the second threshold value at which the restraint control is terminated is set to a value higher than the first threshold value at which restraint control of the engine revolution frequency is started, so that drop of the engine revolution frequency may be reduced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE PREFERRED EMBODIMENTS

Figure 1:
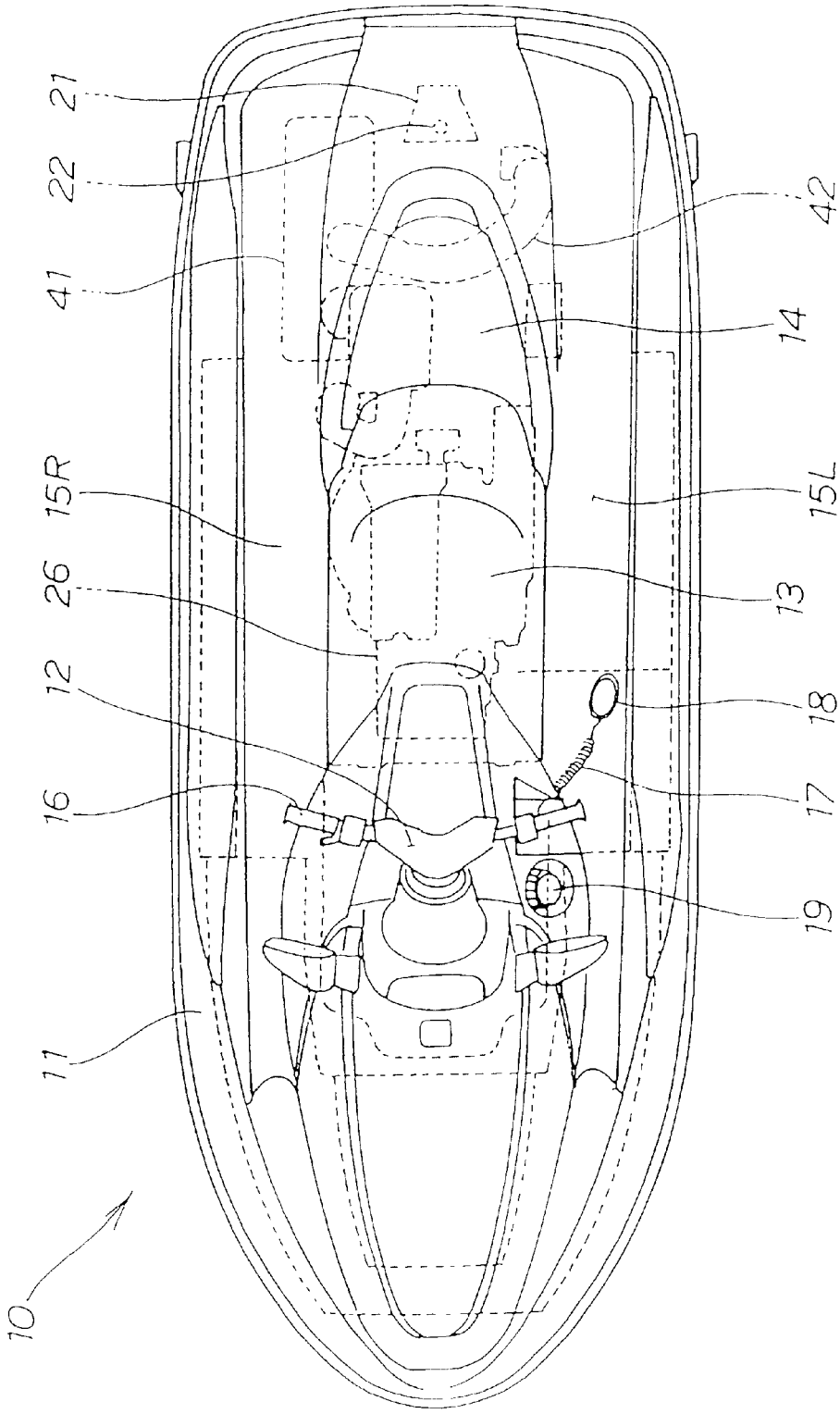
FIG. 1 is a plan view of a jet propulsion boat according to the present invention.

Referring now to the drawings, an embodiment of the present invention will be described. The terms "front", "rear", "left" and "right" represent the direction as viewed by an operator.

FIG. 1 is a plan view of a jet propulsion boat according to the present invention. The jet propulsion boat 10 is provided with a steering handle 12, an operator's seat 13, and a passenger's seat 14 arranged on an upper surface of a vessel body 11 in sequence from the front, and with steps 15L, 15R on the left and right sides of tile seats 13, 14 (L represents the left side, and R represents the right side as viewed by an operator). Units equipped in tile vessel body 11 are simply designated by reference numerals and will be described in conjunction with FIG. 2.

Turning the accelerator grip 16 allows control of the engine revolution frequency, as in the ease of a motorcycle.

A lanyard 17 for stopping the engine is connected at one end to a main switch and connected at the other end to the arm or the body of the operator with a ring 18. The operator stops the engine by applying tension to the lanyard when he or she moves significantly away from the normal operating position, thus pulling off the main switch.

A fuel port 19 allows feeding of fuel into a fuel tank disposed in the vessel body II by removing a cap.

A steering nozzle 21 is capable of swinging to the left and tile right about the pin 22 in association with tile steering handle 12. As a consequence, the direction of injection of jet water is changed and thus the vessel body 11 can be turned (steered).

Figure 2:
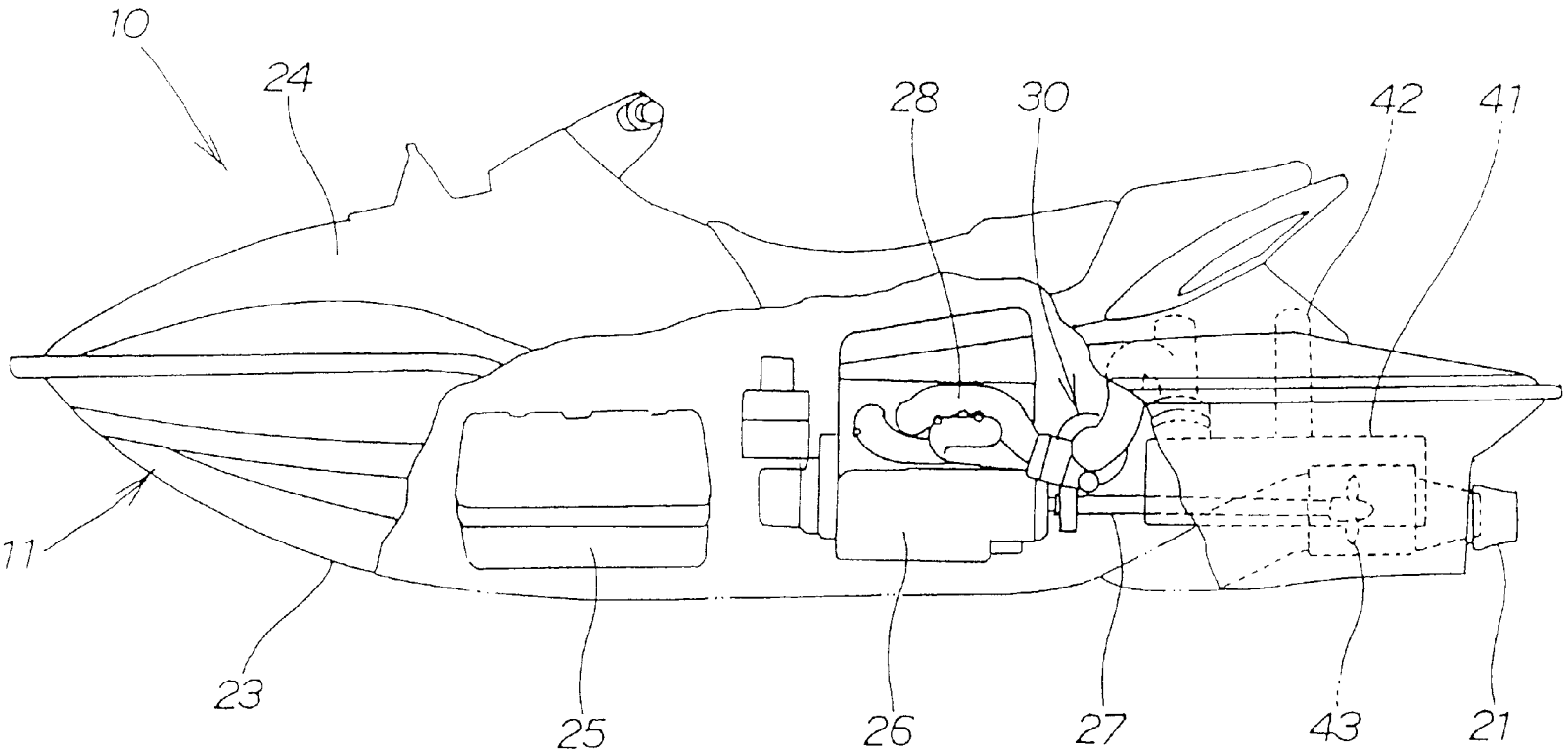
FIG. 2 is a side view of a jet propulsion boat according to the present invention.

FIG. 2 is a side view of a jet propulsion boat according to the present invention. The vessel body 11 is a hollow structure constructed by covering a deck 24 on the hull 23. The jet propulsion boat 10 is referred to as a jet propulsion boat because it is a small craft being provided with a fuel tank 25, an engine 26, a muffler 41, a connecting pipe 42 of inverted U-shape, and so on stored in the vessel body 11. The boat 10 is propelled by injecting jet water generated at the impeller 43 provided at the distal end of the propulsion shaft 27.

Exhaust gas from the engine 26 flows through the exhaust manifold 28, the turbo supercharger 30, the water muffler 41, and the connecting pipe 42 of inverted U-shape in sequence. A part of retained energy flows as intake air into the turbo supercharger 30, and then is muffled and cooled through the water muffler 41 that contains water, and finally is discharged exhaust gas into water or to jet water from the U-shaped connecting pipe 42.

The jet propulsion boat 10 travels on tile water surface at a high speed as so called motorboat, and is a carriage that jumps frequently when it rides on the waves. When the boat jumps, water around the impeller 43 is temporarily reduced, and a load exerted on the engine 26 is reduced. However, when the boat lands on the water after jumping, water rushes into the impeller 43 and thus a load on the engine increases. Such load fluctuation causes an overspeed phenomenon.

Since such load fluctuations may occur in so called land cruisers, which is a type of vehicles being capable of traveling on the rough land, this type of vehicle also requires a countermeasure against overspeed.

Figure 3:
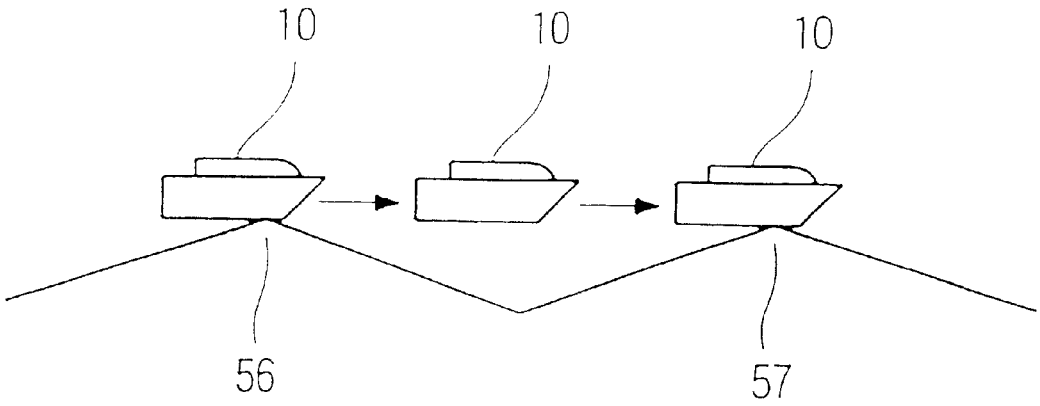
FIGS. 3(*a*) and 3(*b*) are drawings illustrating the operation of a jet propulsion boat.
Figure 3:
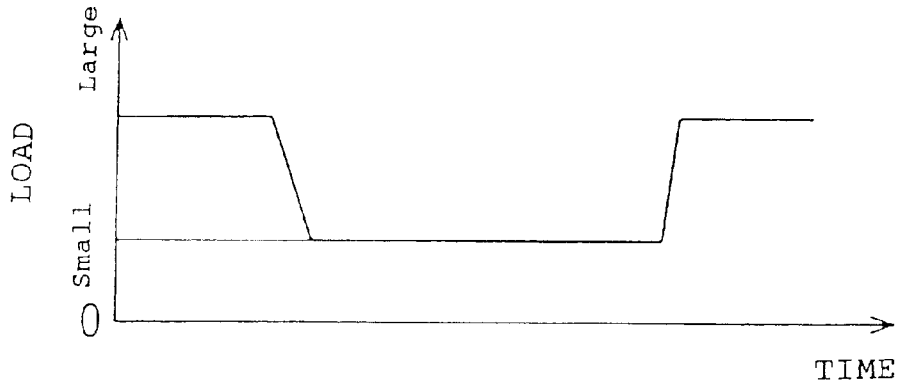

FIGS. 3(*a*) and (*b*) are drawings illustrating operation of a jet propulsion boat.

FIG. 3(*a*) shows a state in which tile jet propulsion boat 10 jumps from the first wave 56 to the second wave 57.

FIG. 3(*b*) shows a graph representing loads exerted in the state shown in FIG. 3(*a*). The load is large when the jet propulsion boat 10 is on the first wave 56, small when the boat is jumping, and increases again when the boat is on the second wave 57.

When the jet propulsion boat 10 jumps during the high-speed travel, the engine revolution frequency abruptly increases, and thus the engine revolution frequency may exceed the allowable maximum engine revolution frequency. Since continuous operation of the engine at the speed exceeding the allowable maximum engine revolution frequency may adversely affect the durability of the engine, control for suppressing the engine revolution frequency is required. This control is referred to as restraint control of the engine revolution frequency.

Figure 4:
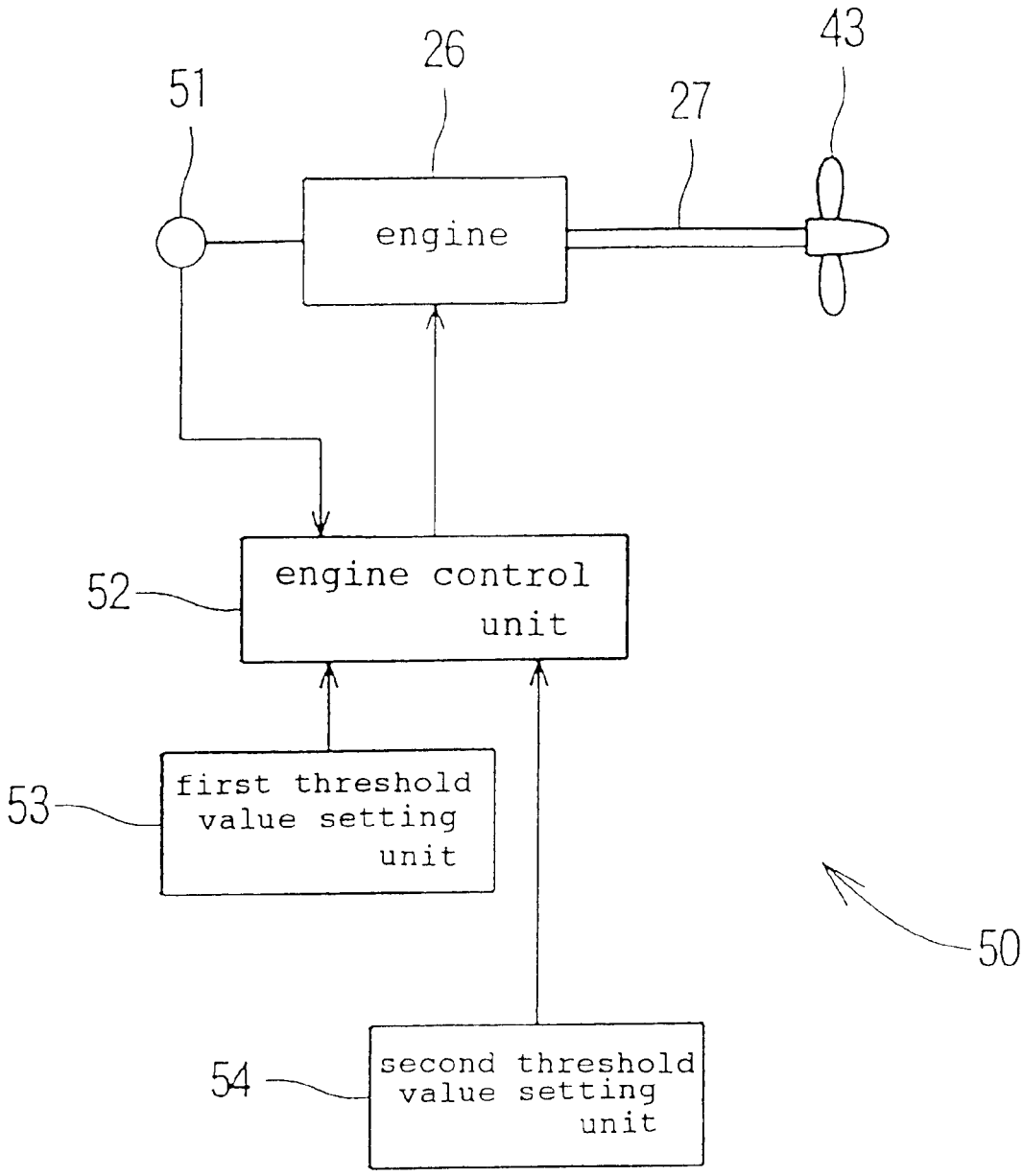
FIG. 4 is a drawing showing a principle of the engine revolution frequency control apparatus according to the present invention.

FIG. 4 is a drawing showing a principle of the engine revolution frequency control apparatus according to the present invention. The engine revolution frequency control apparatus 50 includes the engine revolution frequency detecting means 51 for detecting the revolution frequency of the engine 26, an engine control unit 52 for controlling the revolution frequency of the engine 26, a first threshold value setting unit 53 for setting the first threshold value to be stored in the engine control unit 52, a second threshold value setting unit 54 for setting the second threshold value to be stored in the engine control unit 52.

Figure 5:
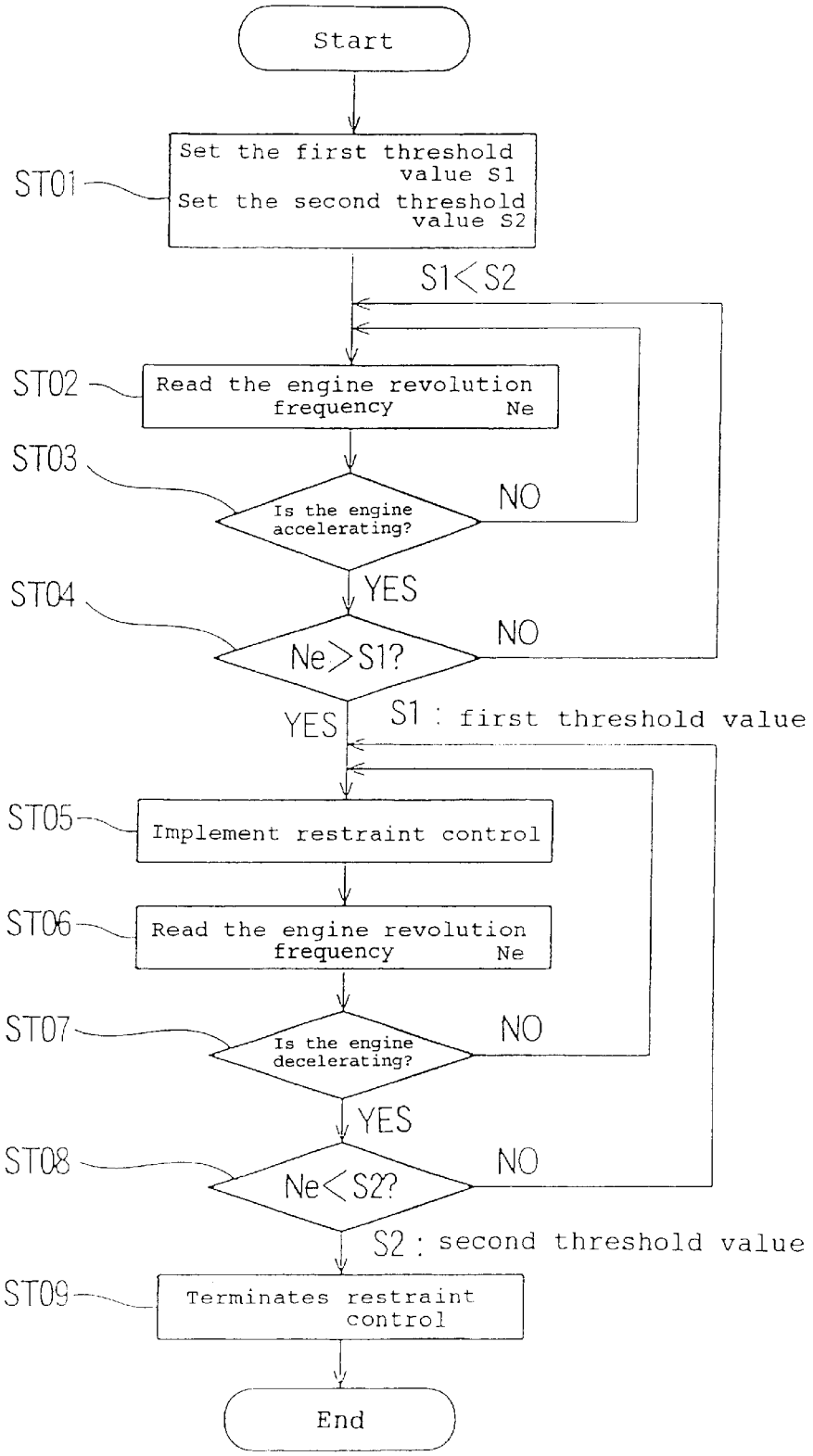
FIG. 5 is a flow chart showing an example of restraint control implemented by the engine control unit.

FIG. 5 is a flow chart showing an example of restraint control implemented by the engine control unit. The reference sign STxx designate the step numbers.

ST01: Set the first threshold value S1 and then set the second threshold value S2 to the engine control unit. What is important here is S1<S2.

When the values S1 and S2 set once are not necessary to be changed, this step can be omitted as a matter of course.

ST02: The engine control unit reads the engine revolution frequency Ne.

ST03: The engine control unit examines whether or not the engine is on the way of acceleration. More specifically, it reads two engine revolution frequencies, the engine revolution frequency Ne1 and the engine revolution frequency Ne2, in a short interval in time sequence. When they are compared and found that Ne1<Ne2, it can be determined that the engine is accelerating. If NO (not accelerating), the engine control unit returns to ST02, and if Yes (accelerating), it proceeds to ST04.

ST04: The engine control unit determined whether or not the engine revolution frequency Ne has exceeded the first threshold value S1. If NO (not exceeded), it returns to ST02, and if Yes (exceeded), it proceeds to ST05.

ST05: The engine control unit implements restraint control of the engine revolution frequency. This restraint control may be achieved by cutting or reducing fuel supply, leaning of air-fuel mixture, delaying ignition timing, reducing the number of times of ignition, or some other known methods.

ST06: The engine control unit reads the engine revolution frequency Ne.

ST07: The engine control unit examines whether or not the engine is decelerating. For example, it reads two engine revolution frequencies, the engine revolution frequency Ne3 and the engine revolution frequency Ne4, in a short interval time series in time sequence. When they are compared and found that Ne3>Ne4, it can be determined that the engine is decelerating. If NO (not decelerating), the engine control unit returns to ST05 and continues restraint control. If Yes (decelerating), it proceeds to ST08.

ST08: The engine control unit determines whether or not the engine revolution frequency Ne has lowered to the value below the second threshold value S2. If NO (not below), it returns to ST05, and if YES (below), it proceeds to ST09.

ST09: The engine control unit terminates restraint control of the engine revolution frequency. The engine is switched to the normal operation now.

Figure 6:
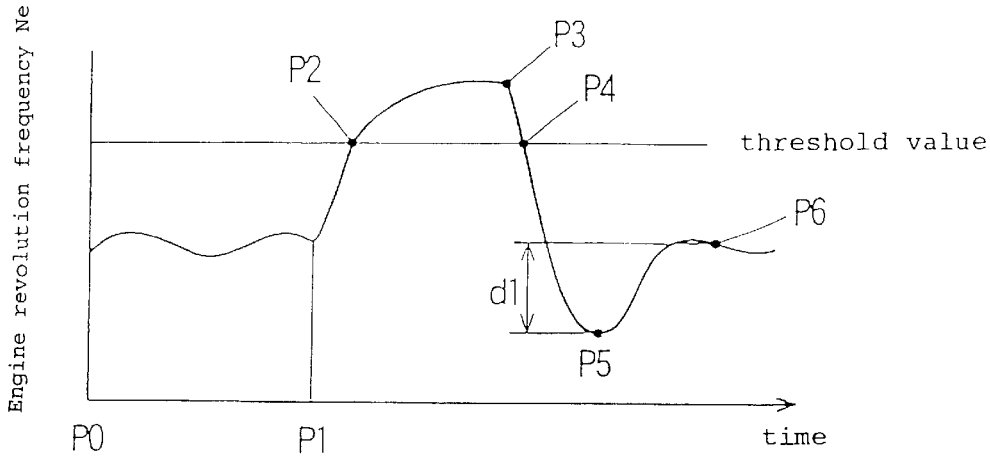
FIG. 6(*a*) is a graph shoving an example of the background art in comparison to the embodiment of the present invention shown in FIG. 6(*b*).
Figure 6:
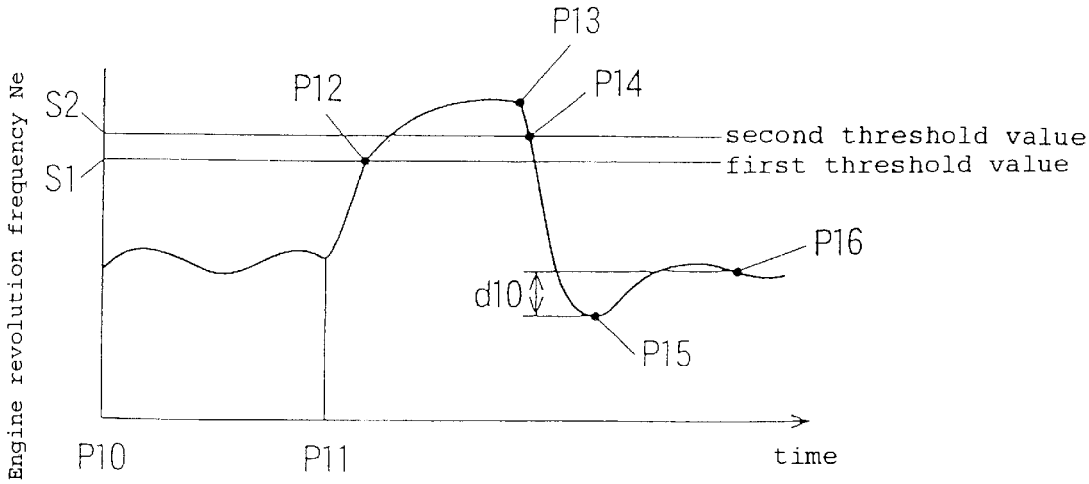

FIGS. 6(*a*) and (*b*) are graphs comparing the present invention and the background art.

FIG. 6(*a*) shows a comparative example, illustrating variations in engine revolution frequency when an overspeed governing capability is provided and starting and terminating of restraint control is implemented at an identical "threshold value".

Though the engine revolution frequency has been varied corresponding to the throttle from the point P0 on the lateral axis, the engine revolution frequency abruptly increases from the point P1 where a load is suddenly decreased due to jumping (See FIG. 3(*a*)) or the like, and exceeds the threshold value at the point P2. Therefore, restraint control of the engine revolution frequency is started, and thus the engine revolution frequency increases along the curved line whereof the pace of increase gradually lowers.

When the engine revolution frequency is in the area higher than the threshold value, the engine revolution frequency abruptly decreases at the point P3 where the load is abruptly increased due to landing on the water (See FIG. 3(*a*)), or the like. When the engine revolution frequency drops to the value below the threshold value at the point P4, restraint control is terminated and the operation changes into the normal operation. However, since increase in load is significant, the engine revolution frequency drops to the point P5. Then, the normal operation works and the engine revolution frequency returns to the revolution frequency (the point P6) corresponding to the throttle. The difference dl between the point P6 and the point P5 is a drop of the engine revolution frequency. When the difference d1 is larger, it comes into a state in which harsh braking is applied during the travel, and thus the feeling of travel is not good.

FIG. 6(*b*) shows an embodiment of the present invention illustrating variations in the engine revolution frequency when an overspeed governing capability is provided and starting of restraint control is implemented at the first threshold value S1, and termination of restraint control is implemented at the second threshold value S2 (where S1<S2).

Though the engine revolution frequency has been varied from the point P10 on the lateral axis corresponding to the throttle, the engine revolution frequency abruptly increases from the point P11 when a load suddenly decreases due to jumping (See FIG. 3(*a*)) or the like, and exceeds the first threshold value S1 at the point P12. Therefore, restraint control of the engine revolution frequency is started, and thus, the engine revolution frequency increases along the curved line whereby the pace of increase gradually lowers.

When a load abruptly increases due to landing on the water (See FIG. 3(*a*)), or the like, at the point P13 in a state in which the engine revolution frequency exceeds the first threshold value S1, and in the area higher than the second threshold value S2, the engine revolution frequency abruptly decreases. When the engine revolution frequency drops to the value below the second threshold value at the point P14, restraint control terminates and the operation changes into the normal operation. However, since increase in load is significant, the engine revolution frequency drops to the point P15. Then, the normal operation works and the engine revolution frequency returns to the revolution frequency (the point P16) corresponding to the throttle. The difference d10 between the point P16 and the point P15 is a drop of the engine revolution frequency.

The difference d10 is a fraction of the difference d1 shown in FIG. 6(*a*), and thus is small enough.

The smaller the difference d10, the lower the feeling of braking during the travel, and thus the feeling of travel is improved.

As is clear from the description above, the present invention provides an engine 26 including the engine revolution frequency detecting means 51 for detecting the revolution frequency of the engine 26 shown in FIG. 4, and the engine control unit 52 for controlling the revolution frequency of the engine 26. The engine control unit 52 is provided with an overspeed governing capability that starts restraint control for restraining the engine revolution frequency when the engine revolution frequency detected by the engine revolution frequency detecting means 51 exceeds the first threshold value S1 during acceleration (See ST05 in FIG. 5), and terminates restraint control when the engine revolution frequency detected by the engine revolution frequency detecting means 51 is lowered to the value below the second threshold value S2 during deceleration (See ST07 in FIG. 5). Further, the second threshold value S2 is set to the engine revolution frequency higher than the first threshold value S1.

The engine revolution frequency control apparatus and restraint control of revolution frequency according to the present invention is suitable for jet propulsion boats, and it is needless to say that it can also be applied widely to other general vehicles, working vehicles, engines for industrial machineries, and other engines.

With the arrangement described above, the present invention exercises the following effects.

The second threshold value at which restraint control is terminated is set to the value higher than the first threshold value at which restraint control of the engine revolution frequency is started, so as to reduce drop of the engine revolution frequency. Accordingly, feeling of rattling during travel is reduced, and thus feeling of travel is improved.

In addition, since restraint control is implemented, damage of the engine due to overspeed operation can be prevented, and thus protection of the engine can be achieved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An engine comprising:

revolution frequency detecting means for detecting changes in an engine revolution frequency; and an engine control unit for controlling the engine revolution frequency, said engine control unit including an overspeed governing capability that starts restraint control for restraining rotation when the engine revolution frequency detected by said engine revolution frequency detecting means exceeds a first threshold value when the engine is accelerating, and terminates restraint control when the engine revolution frequency decreases to the value below a second threshold value when the engine is decelerating, wherein the second threshold value is set to be higher than the first threshold value.

2. The engine according to claim 1, wherein said revolution frequency detection means reads the engine revolution frequency twice in a predetermined interval of time to determine whether the engine is accelerating or decelerating.

3. The engine according to claim 1, wherein restraint control is achieved by reducing a supply of fuel, delaying an ignition timing, leaning an air-fuel mixture, or reducing a number of times of ignition.

4. The engine according to claim 1, the engine driving a jet propulsion boat or a land cruiser.

5. The engine revolution frequency control frequency apparatus according to claim 1, the engine driving a jet propulsion boat or a land cruiser.

6. An engine revolution frequency control apparatus comprising:

revolution frequency detecting means for detecting changes in an engine revolution frequency;

a first threshold value setting unit for setting a first engine revolution frequency threshold value;

a second threshold setting unit for setting a second engine revolution frequency threshold value; and an engine control unit for controlling the engine revolution frequency, said engine control unit including an overspeed governing capability that starts restraint control for restraining rotation when the engine revolution frequency detected by said engine revolution frequency detecting means is more than said first threshold value when the engine is accelerating, and terminates restraint control when the engine revolution frequency is less than said second threshold value when the engine is decelerating, wherein said second threshold value is set to be higher than said first threshold value.

7. The engine revolution frequency control apparatus according to claim 6, wherein said revolution frequency detection means reads the engine revolution frequency twice in a predetermined interval of time to determine whether the engine is accelerating or decelerating.

8. The engine revolution frequency control apparatus according to claim 6, wherein restraint control is achieved by reducing a supply of fuel, delaying an ignition timing, leaning an air-fuel mixture, or reducing a number of times of ignition.

9. A method of controlling a revolution frequency of an engine, comprising the steps of:

setting first and second revolution frequency threshold values, wherein said first threshold value is greater than said second threshold value;

detecting an engine revolution frequency during acceleration;

implementing restraint control when said engine revolution frequency is greater than said first threshold value;

detecting an engine revolution frequency during deceleration; and implementing restraint control when said engine revolution frequency is less than said second threshold value.

10. The method of controlling a revolution frequency of an engine according to claim 9, wherein said detecting steps include reading the engine revolution frequency twice in a predetermined interval of time to determine whether the engine is accelerating or decelerating.

11. The method of controlling a revolution frequency of an engine according to claim 9, wherein the steps of implementing restraint control are achieved by reducing a supply of fuel, delaying an ignition timing, leaning an air-fuel mixture, or reducing a number of times of ignition.

12. The method of controlling a revolution frequency control frequency of an engine according to claim 9, wherein the engine drives a jet propulsion boat or a land cruiser.

* * * * *